US007467628B2

(12) United States Patent
Adams et al.

(10) Patent No.: US 7,467,628 B2
(45) Date of Patent: Dec. 23, 2008

(54) OXYGEN SENSOR HEATER CONTROL METHODS AND SYSTEMS

(75) Inventors: Justin F. Adams, Ypsilanti, MI (US); Louis A. Avallone, Milford, MI (US); Dale W. McKim, Howell, MI (US); Jeffrey A. Sell, West Bloomfield, MI (US); John W. Siekkinen, Novi, MI (US); Julian R. Verdejo, Farmington, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 59 days.

(21) Appl. No.: 11/669,238

(22) Filed: Jan. 31, 2007

(65) Prior Publication Data

US 2008/0178856 A1 Jul. 31, 2008

(51) Int. Cl.
*F02D 41/00* (2006.01)
*F02D 41/02* (2006.01)

(52) U.S. Cl. ..... 123/697

(58) Field of Classification Search ..... 123/697, 123/685, 703, 672; 73/23.25, 23.32, 118.1
See application file for complete search history.

(56) References Cited

U.S. PATENT DOCUMENTS

| | | | | | |
|---|---|---|---|---|---|
| 4,655,182 | A * | 4/1987 | Nakano et al. | 123/179.1 |
| 4,708,777 | A * | 11/1987 | Kuraoka | 205/784.5 |
| 5,353,774 | A * | 10/1994 | Furuya | 123/685 |
| 5,596,975 | A * | 1/1997 | Thomas et al. | 123/686 |
| 5,676,811 | A * | 10/1997 | Makino et al. | 204/425 |
| 5,701,877 | A * | 12/1997 | Aoki | 123/697 |
| 5,836,292 | A * | 11/1998 | Aoki | 123/697 |
| 5,901,553 | A * | 5/1999 | Cullen | 60/274 |
| 6,314,790 | B1 * | 11/2001 | Sagisaka et al. | 73/23.31 |
| 6,651,639 | B2 * | 11/2003 | Hada et al. | 123/697 |
| 6,781,098 | B2 * | 8/2004 | Toyoda | 219/501 |
| 2002/0078938 | A1 * | 6/2002 | Hada et al. | 123/697 |
| 2003/0019486 | A1 * | 1/2003 | Hada et al. | 123/697 |

* cited by examiner

*Primary Examiner*—Mahmoud Gimie

(57) ABSTRACT

A control system for an oxygen sensor heater is provided. The control system includes a passive heater control module that generates a heater control signal at a first duty cycle and measures a resistance of the oxygen sensor heater. An exhaust gas temperature mapping module maps the resistance to an exhaust gas temperature. An active heater control module generates a heater control signal at a second duty cycle based on the exhaust gas temperature.

11 Claims, 5 Drawing Sheets

OXYGEN SENSOR HEATER CONTROL METHODS AND SYSTEMS

FIELD

The present disclosure relates to methods and systems for controlling an oxygen sensor heater.

BACKGROUND

The statements in this section merely provide background information related to the present disclosure and may not constitute prior art.

Engine control systems manage air and fuel delivery to the engine based on either open loop or closed loop feedback control methods. Open loop control methods are typically initiated during specific operating conditions such as start up, cold engine operation, heavy load conditions, wide open throttle, and intrusive diagnostic events, etc. An engine control system typically employs closed loop control methods to maintain the air/fuel mixture at or close to an ideal stoichiometric air/fuel ratio. Closed loop fuel control commands a desired fuel delivery based on an oxygen content in the exhaust. The oxygen content in the exhaust is determined by oxygen sensors that are located downstream of the engine.

Oxygen sensors generate a voltage signal proportional to the amount of oxygen in the exhaust. Oxygen sensors typically compare the oxygen content in the exhaust with an oxygen content in the outside air. As the amount of unburned oxygen in the exhaust increases, the voltage output of the sensor drops. Most oxygen sensors must be heated before they can effectively operate. Heater elements present in the oxygen sensor heat the sensor to a desired operating temperature.

Cracking of oxygen sensor elements may occur due to thermal shock. Cracking is thought to be due to water droplets, which are produced by combustion and borne by the exhaust gas stream, coming in contact with a ceramic element of the oxygen sensor. While the engine warms up, moisture can be present in the exhaust system. In some cases, the liquid moisture, entrained by the passing gas flow, may come in to direct contact with the oxygen sensor elements. If the element has, by this point in time, reached a hot enough temperature, the water droplet can cause the ceramic element to crack.

SUMMARY

Accordingly, a control system for an oxygen sensor heater is provided. The control system includes a passive heater control module that generates a heater control signal at a first duty cycle and measures a resistance of the oxygen sensor heater. An exhaust gas temperature (EGT) mapping module maps the resistance to an exhaust gas temperature. An active heater control module generates a heater control signal at a second duty cycle based on the exhaust gas temperature.

In other features, an engine system is provided. The engine system includes an engine. At least one oxygen sensor is disposed downstream of the engine wherein the oxygen sensor includes an oxygen sensor heater. A control module measures a resistance of the oxygen sensor heater, maps the resistance to an exhaust gas temperature, and selectively delays activation of the oxygen sensor heater based on the exhaust gas temperature and a dewpoint temperature threshold.

In still other features, a method of controlling an oxygen sensor heater is provided. The method includes: measuring a resistance of an oxygen sensor heater; mapping the resistance to an exhaust gas temperature; selectively delaying activation of the oxygen sensor heater based on the exhaust gas temperature and a dewpoint temperature threshold; and activating the oxygen sensor heater once the exhaust gas temperature exceeds the dewpoint temperature threshold.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
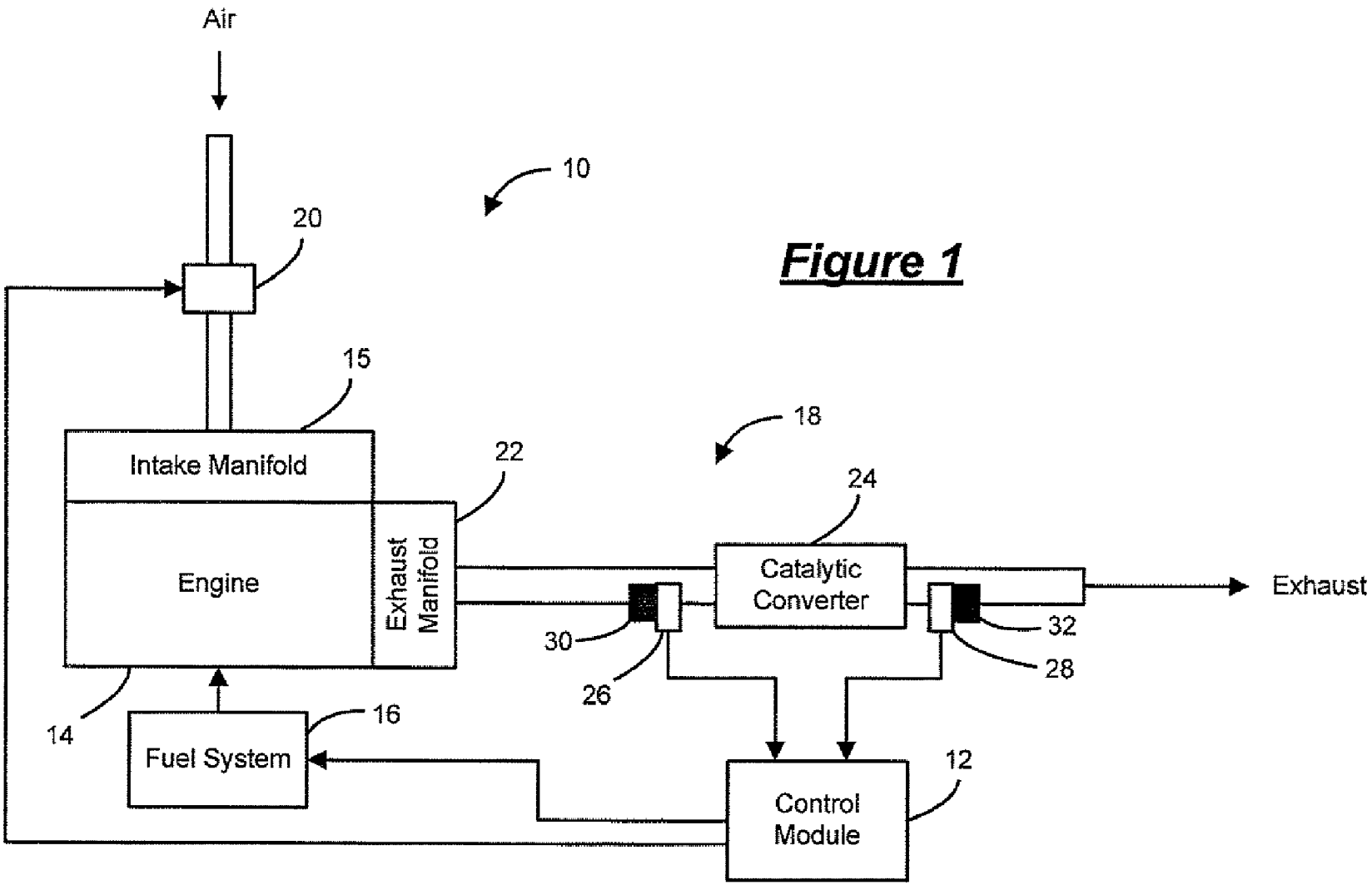
FIG. 1 is a functional block diagram of a vehicle including an oxygen sensor heater control system.

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Referring now to FIG. 1, a vehicle 10 includes a control module 12, an engine 14, a fuel system 16, and an exhaust system 18. A throttle 20 communicates with the control module 12 to control air flow into an intake manifold 15 of the engine 14. The amount of torque produced by the engine 14 is proportional to mass air flow (MAF) into the engine 14. The engine 14 operates in a lean condition (i.e. reduced fuel) when the A/F ratio is higher than a stoichiometric A/F ratio. The engine 14 operates in a rich condition when the A/F ratio is less than the stoichiometric A/F ratio. Internal combustion within the engine 14 produces exhaust gas that flows from the engine 14 to the exhaust system 18, which treats the exhaust gas and releases the exhaust gas to the atmosphere. The control module 12 communicates with the fuel system 16 to control the fuel supply to the engine 14.

The exhaust system 18 includes an exhaust manifold 22, a catalytic converter 24, and one or more oxygen sensors. The catalytic converter 24 controls emissions by increasing the rate of oxidization of hydrocarbons (HC) and carbon monoxide (CO) and the rate of reduction of nitrogen oxides ($NO_x$). To enable oxidization, the catalytic converter 24 requires oxygen. The oxygen sensors provide feedback to the control module indicating a level of oxygen in the exhaust. Based on the oxygen sensor signals, the control module controls air and fuel at a desired air-to-fuel (A/F) ratio in an effort to provide optimum engine performance as well as to provide optimum catalytic converter performance. Controlling air and fuel based on one or more oxygen sensor feedback signals is referred to as operating in a closed loop mode. It is appreciated that the present disclosure contemplates various oxygen sensors that can be located at various locations within the exhaust system 18.

In an exemplary embodiment, as shown in FIG. 1, the exhaust system includes an inlet oxygen ($O_2$) sensor 26 located upstream from the catalytic converter 24, and an outlet ($O_2$) sensor 28 located downstream from the catalytic converter 24. The inlet $O_2$ sensor 26 communicates with the control module 12 and measures the $O_2$ content of the exhaust stream entering the catalytic converter 24. The outlet $O_2$ sensor 28 communicates with the control module 12 and measures the $O_2$ content of the exhaust stream exiting the catalytic converter 24. The control module 12 controls air and fuel based on the inlet and outlet oxygen sensor signals such that a sufficient level of $O_2$ is present in the exhaust to initiate oxidation in the catalytic converter 24.

Oxygen sensors 26, 28 include an internal heating element that allows the sensors to reach a desired operating temperature more quickly and to maintain the desired temperature during periods of idle or low engine load. As shown in FIG. 1, the inlet $O_2$ sensor 26 and the outlet $O_2$ sensor 28 include $O_2$ heaters 30, 32 respectively. The control module 12 controls power to the $O_2$ heaters 30, 32 based on the oxygen sensor heater control systems and methods of the present disclosure.

Figure 2:
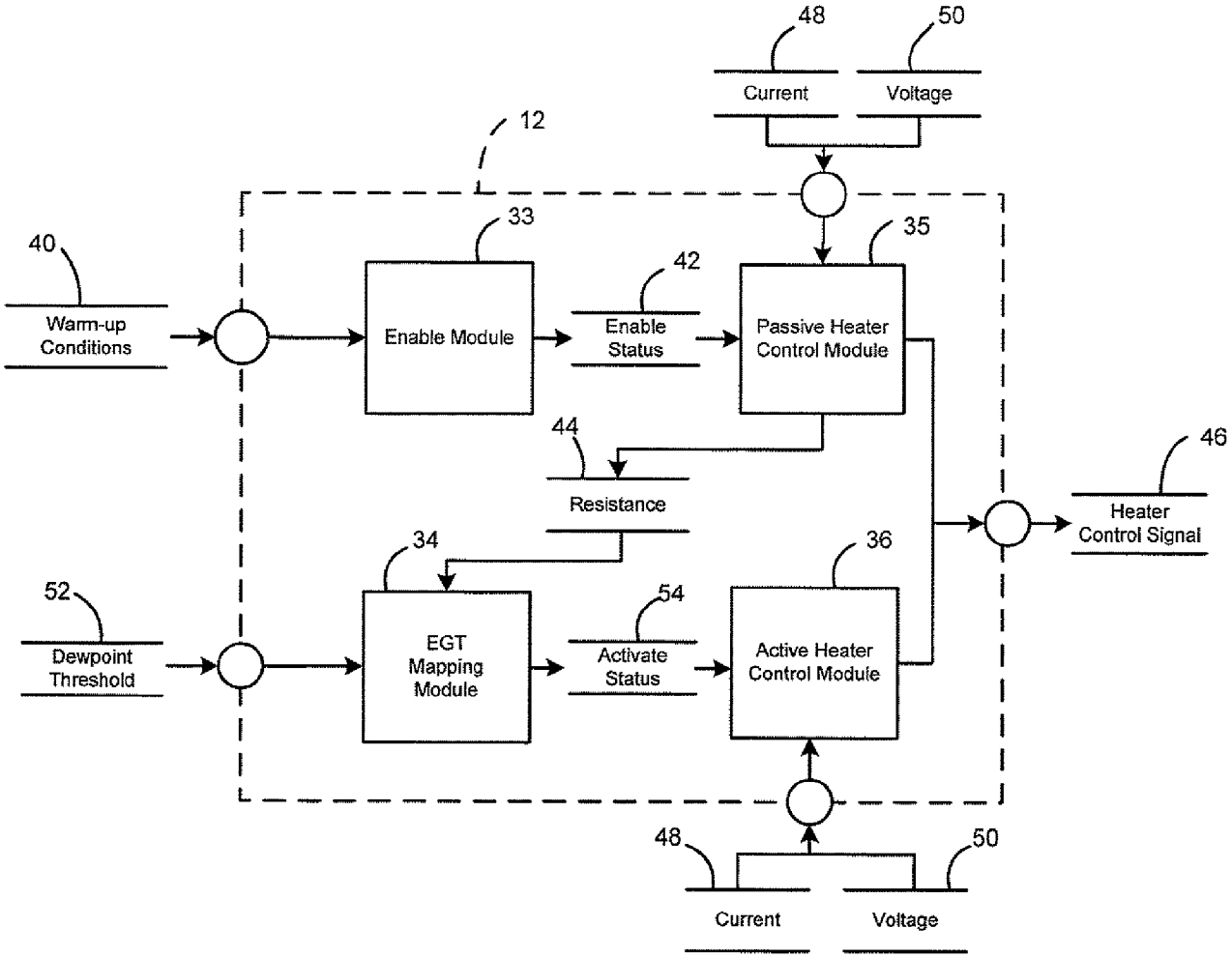
FIG. 2 is a dataflow diagram of an oxygen sensor heater control system.

Referring now to FIG. 2, a dataflow diagram illustrates various embodiments of an oxygen sensor heater control system that may be embedded within the control module 12. Various embodiments of oxygen sensor heater control systems according to the present disclosure may include any number of sub-modules embedded within the control module 12. The sub-modules shown may be combined and/or further partitioned to similarly control functions of $O_2$ heaters 30, 32 (FIG. 1) during warm-up conditions. Inputs to the system may be sensed from the vehicle 10 (FIG. 1), received from other control modules (not shown) within the vehicle 10 (FIG. 1), and/or determined by other sub-modules (not shown) within the control module 12. In various embodiments, the control module 12 of FIG. 2 includes an enable module 33, a passive heater control module 35, an exhaust gas temperature (EGT) mapping module 34, and an active heater control module 36.

The enable module 33 selectively enables the passive heater control module 35 to control at least one of the $O_2$ heaters 30, 32 via an enable flag 42. The enable module 33 monitors engine warm-up conditions and sets the enable flag 42 to TRUE once engine warm-up conditions are met. Otherwise, the enable flag 42 remains set to FALSE. Engine warm-up conditions can be based on, but are not limited to, engine off time, intake air temperature, and engine coolant temperature.

Figure 3A:
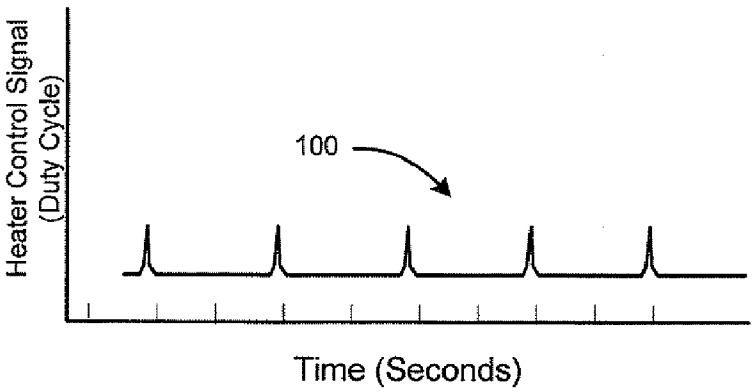
FIGS. 3A and 3B illustrate control signals generated according to one of passive heater control and active heater control methods.

The passive heater control module 35 controls at least one of the $O_2$ heaters 30, 32 via a heater control signal 46 to measure a resistance of the $O_2$ heater. The passive heater control module 35 generates the heater control signal 46 at a minimum duty cycle such that a resistance 44 can be measured while minimizing self-heating of the $O_2$ heater. The passive heater control module 35 determines the duty cycle based on a predetermined time and/or frequency. The time and/or frequency can be predetermined based on the control system and heater properties. FIG. 3A illustrates an exemplary heater control signal 100 generated by the passive heater control module 35. As shown, a minimal duty cycle is commanded at smaller frequencies. After generating the heater control signal, the resistance 44 of the $O_2$ heater can be measured based on the current 48 flowing to the heater (amps) and the voltage 50 at the oxygen sensor. For example, resistance 44 can be determined from the fundamental electrical equation:

$$V=I*R \rightarrow R=V/I.$$

Where V equals voltage and 1 equals current. Methods and systems for measuring $O_2$ heater resistance are disclosed in commonly assigned U.S. Pat. No. 6,586,711, and are incorporated herein by reference.

Figure 4:
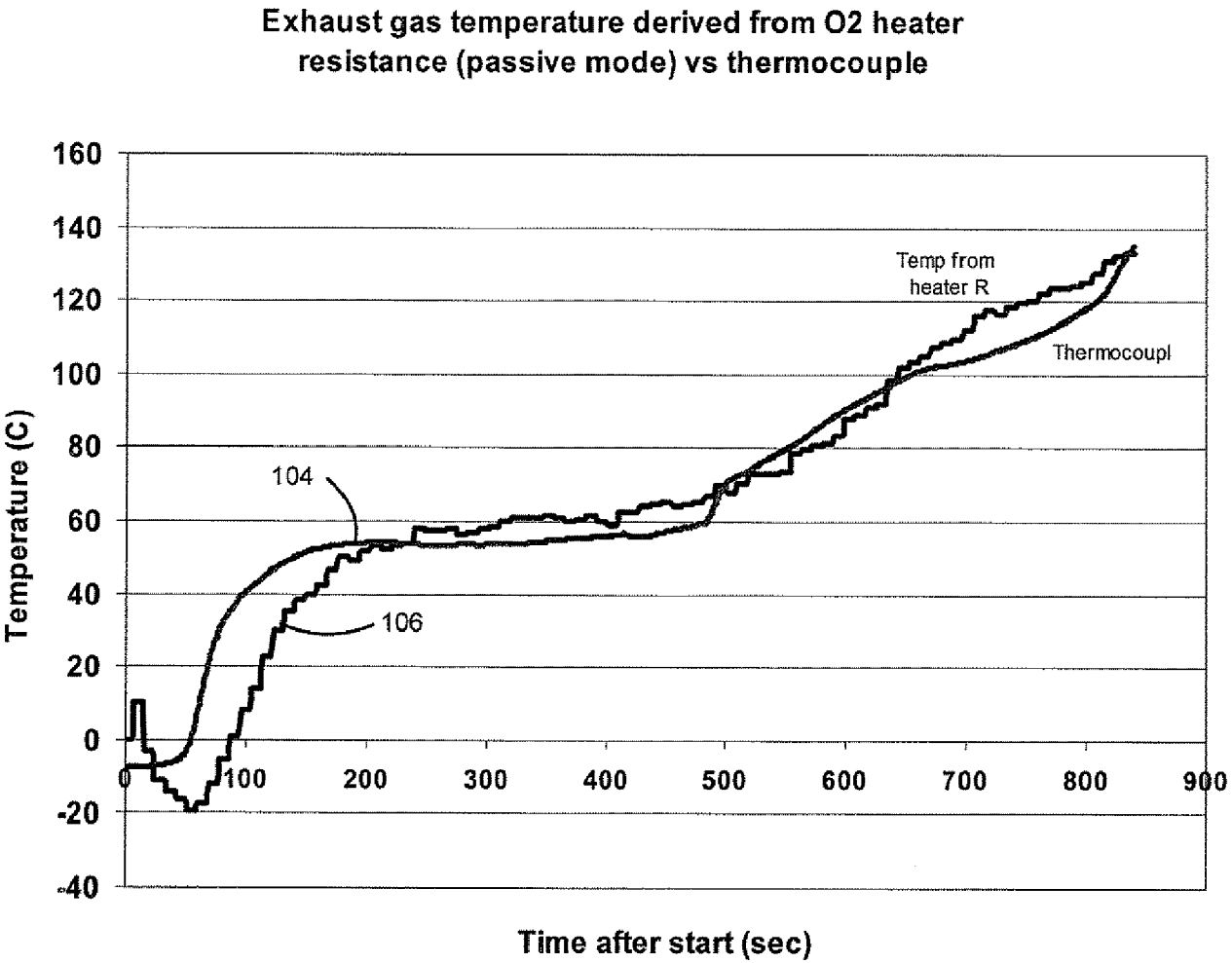
FIG. 4 is a graphical representation of exhaust gas temperature and an estimated exhaust gas temperature.

Referring back to FIG. 2, the EGT mapping module 34 maps the measured resistance 44 to one of an $O_2$ heater temperature or an $O_2$ element temperature. In various embodiments, the measured resistance 44 is mapped to the $O_2$ heater temperature based on a lookup table defined by resistance 44. The EGT mapping module 34 then associates the $O_2$ heater temperature or $O_2$ element temperature with an exhaust gas temperature. As can be seen in the graph of FIG. 4, the exhaust gas temperature derived from the measured resistance shown at 106 tracks the actual exhaust gas temperature at 104.

Referring back to FIG. 2, based on the exhaust gas temperature, the EGT mapping module 34 sets an activate heater flag 54. More particularly, once the exhaust gas temperature exceeds a dewpoint temperature threshold 52, the activate heater flag 54 is set to TRUE. Otherwise the activate heater flag 54 remains set to FALSE. Waiting until the exhaust gas temperature exceeds the dewpoint temperature threshold 52 provides a sufficient delay for water present on the $O_2$ sensor to evaporate. As can be appreciated, the dewpoint temperature threshold can be predetermined based on $O_2$ heater properties.

Figure 3B:
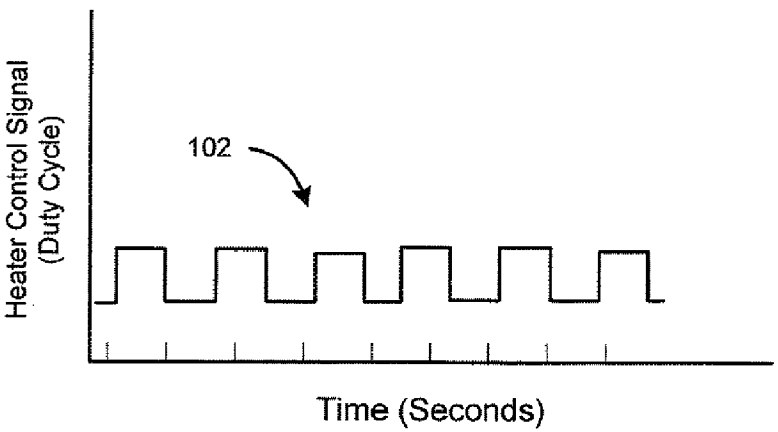

The active heater control module 36 generates a heater control signal 46 to activate the $O_2$ heater once the activate heater flag 54 is TRUE. As shown in FIG. 3B, the active heater control module 36 generates a heater control signal 102 at a duty cycle sufficient to maintain an operating temperature of the $O_2$ sensor. The duty cycle is determined based on the current 48 and voltage 50. Once the $O_2$ heater is activated via the heater control signal 46, the control module 12 can begin controlling fuel and air according to closed loop control methods.

Figure 5:
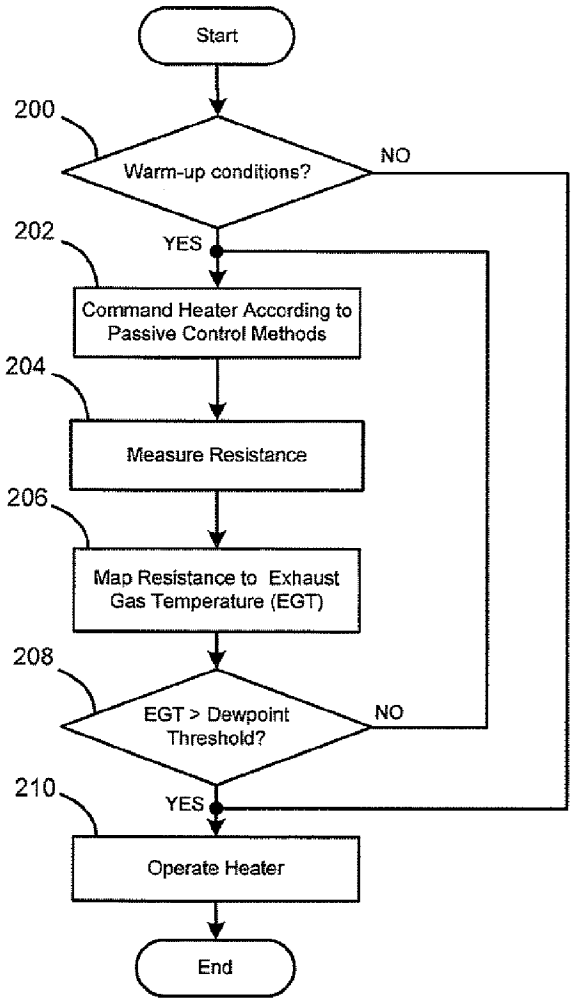
FIG. 5 is a flowchart illustrating an oxygen sensor heater control method.

Referring now to FIG. 5, a flowchart illustrates an oxygen sensor heater control method as performed by the control module 12 of FIG. 2. The method may be run periodically during engine warm-up conditions. Warm-up conditions are evaluated at 200. If warm-up conditions exist at 200, control commands a heater control signal to the $O_2$ heater according to a time and/or frequency sufficient to measure a resistance at 202. Control measures the $O_2$ heater resistance based on an applied voltage and current draw at 204. Control maps the measured resistance to an exhaust gas temperature (EGT) at 206. The EGT is evaluated at 208. If the EGT is greater than a predetermined dewpoint temperature threshold at 208, control activates the $O_2$ heater according to active heater control methods at 210.

Otherwise, control loops back and continues to command a heater control signal according to passive heater control methods at 202. Once the $O_2$ heater is turned on at 210 and the operating temperature of the $O_2$ sensor reaches a predetermined threshold, closed loop control may begin. Prior to activating the heater, open loop control is performed. As can be appreciated, if warm-up conditions do not exist at 200, control can skip over passive heater control at 202-208 and proceed to operate the heater based on active heater control methods at 210.

As can be appreciated, all comparisons made above can be implemented in various forms depending on the selected values for the comparison. For example, a comparison of "greater than" may be implemented as "greater than or equal to" in various embodiments.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. An oxygen sensor heater control system, comprising:

at least one oxygen sensor disposed downstream of an engine wherein the oxygen sensor includes an oxygen sensor heater; and a control module that measures a resistance of the oxygen sensor heater, maps the resistance to an exhaust gas temperature, and selectively delays activation of the oxygen sensor heater based on the exhaust gas temperature and a dewpoint temperature threshold.

2. The system of claim 1 wherein the control module measures the resistance by generating a heater control signal at a minimum duty cycle to the oxygen sensor heater and measuring an applied voltage and a current draw.

3. The system of claim 1 wherein the control module measures the resistance by initiating power to the oxygen sensor heater based on at least one of a time threshold and a frequency threshold.

4. The system of claim 1 wherein the control module initiates power to the oxygen sensor heater based on engine warmup conditions.

5. The system of claim 1 wherein the control module initiates power to the oxygen sensor heater to activate the oxygen sensor heater when the resistance of the oxygen sensor heater indicates that the exhaust gas temperature exceeds the dewpoint temperature threshold.

6. The system of claim 1 wherein the dewpoint temperature threshold is predetermined based on oxygen sensor heater properties.

7. A method of controlling an oxygen sensor heater, comprising:

measuring a resistance of an oxygen sensor heater;

mapping the resistance to an exhaust gas temperature;

selectively delaying activation of the oxygen sensor heater based on the exhaust gas temperature and a dewpoint temperature threshold; and activating the oxygen sensor heater upon the resistance corresponding to an exhaust gas temperature that exceeds the dewpoint temperature threshold.

8. The method of claim 7 further comprising monitoring engine warm-up conditions and wherein the measuring and delaying occurs once the engine warm-up conditions occur.

9. The method of claim 7 further comprising initiating power to the oxygen sensor heater based on a minimum duty cycle and wherein the measuring occurs based on the power.

10. The method of claim 9 wherein the initiating power to the oxygen sensor heater is based on at least one of a predetermined time and a predetermined frequency.

11. The system of claim 7 further comprising controlling air and fuel based on closed loop control methods when the exhaust gas temperature exceeds the dewpoint temperature threshold.

* * * * *